United States Patent [19]

Hastings

[11] Patent Number: 4,909,323

[45] Date of Patent: Mar. 20, 1990

[54] GROUTING WELL PIPE

[76] Inventor: James E. L. Hastings, 440 W. Glass Rd., Ortonville, Mich. 48462

[21] Appl. No.: 358,839

[22] Filed: May 30, 1989

[51] Int. Cl.[4] ..... E21B 33/136; E21B 33/14

[52] U.S. Cl. ..... 166/242; 166/289; 166/317; 405/236

[58] Field of Search ..... 166/285, 286, 289, 292, 166/296, 242, 317, 164, 202, 97.5; 405/233, 236, 248

[56] References Cited

U.S. PATENT DOCUMENTS

| | | | |
|---|---|---|---|
| 2,546,978 | 4/1951 | Collins et al. | 166/202 X |
| 2,572,533 | 10/1951 | Steward | 166/202 |
| 2,913,051 | 11/1959 | Lister | 166/296 X |
| 3,055,424 | 9/1962 | Allen | 166/285 |
| 3,110,347 | 11/1963 | Howard et al. | 166/285 |
| 3,512,365 | 5/1970 | Muller | 405/236 |
| 3,851,490 | 12/1974 | Matsushita | 405/248 |
| 4,191,492 | 3/1980 | Cobbs | 166/289 X |

FOREIGN PATENT DOCUMENTS

| | | | |
|---|---|---|---|
| 788633 | 1/1958 | United Kingdom | 405/236 |

*Primary Examiner*—Stephen J. Novosad
*Attorney, Agent, or Firm*—Harness, Dickey & Pierce

[57] ABSTRACT

A grouting well pipe for a water well. The grouting well pipe has a central well pipe with at least one grouting tube attached along its length. The grouting tube is sealed along its lower end and length to prevent clogging of the grout tube during insertion of the grouting well pipe into a water well. The grouting tube has a grout release structure thereon for release of grout into the space between the grouting well pipe and the water well in response to pumping grout at a predetermined pressure into the grout tube. This seals the space effectively from surface contamination entering the well.

10 Claims, 1 Drawing Sheet

10
12
14
16
18
20
22
24
26
28
28a
28b
28c
28d
30
32
34
36
38
38a
38b
40
42
44
46
47
48
50
52
54
55
56
60
62
64
66
68
70
3
4
5

GROUTING WELL PIPE

BACKGROUND OF THE INVENTION

The present invention relates to a well pipe for installation in a water well. More particularly, the present invention relates to a water well pipe for installation in a water well which provides for grouting between the water well pipe and the walls of the well.

Commonly, in water wells drilled in the past, a standard well pipe tubing was inserted into a pre-drilled well hole to provide for pumping of water from the drilled well by way of a pump. In installations of the past it was believed that no form of sealing means other than normal backfill in the space between the side walls of the well hole and the well pipe was necessary or desirable and therefore, was generally not provided.

In recent years however, the pollution of wells from surface contaminants entering in this backfilled space has been found to be a problem. The commonly used procedures for attempting to remedy this problem have proved to be inadequate.

For instance, the common practice today used to remedy this problem includes an inverted rubber funnel shaped boot which is attached to the base of the well pipe. The boot is designed to securely engage the pipe near the base of the pipe and to also engage the wall surfaces of the well hole. While this is somewhat effective at reducing contaminants it has two major problems. One problem is that the drilled well surfaces are not always smooth and therefore, the boot does not engage the surfaces completely. This allows gaps between the edge of the boot and the walls of the well hole where contaminants can enter. The second problem is that the boot is generally installed such that it is at the end of the well pipe which in normal practice is invariably at or below the water table. Because of this, contaminants may enter the water well above the boot which circumvents the purpose of the boot.

In other cases, well installers sometimes attempt to fill this gap by pouring a grouting material from the surface into the space. Because no efficient and inexpensive method has been heretofore disclosed which provides for a simple efficient method for grouting around the well pipe, this grouting in the past has generally been done with buckets of slurry type grouting materials such as bentonite and the like which are dumped from the surface into this gap. However, due to the depth of most wells such an application of a grouting material is inefficient at best and tends to be incomplete in that a complete filling of the spaces between the well casing and the well hole is not accomplished by these methods. Additionally, such incomplete grouting may actually be detrimental to the well because it may leave gaps in the space which could fill with water and cause freeze-thaw damage to the well pipe.

It has therefore been a goal in the water well art to provide an efficient and cost effective method for grouting substantially the entire gap between the pipe and the sides of the water well.

It is therefore an object of the present invention to provide an inexpensive and efficient method for sealing the gap between the well pipe and the well hole for preventing the entry of surface contamination into the ground water through this gap.

It is still further an object of the present invention to provide a well pipe which includes integrally formed grouting tube assemblies for injecting grout into the space between the well pipe and the drilled well hole.

Additional benefits and advantages of the present invention will become apparent from the subsequent description of the preferred embodiments taken in conjunction with the accompanying drawings.

SUMMARY OF THE INVENTION

Figures 1, 2, 3, 4, 5:
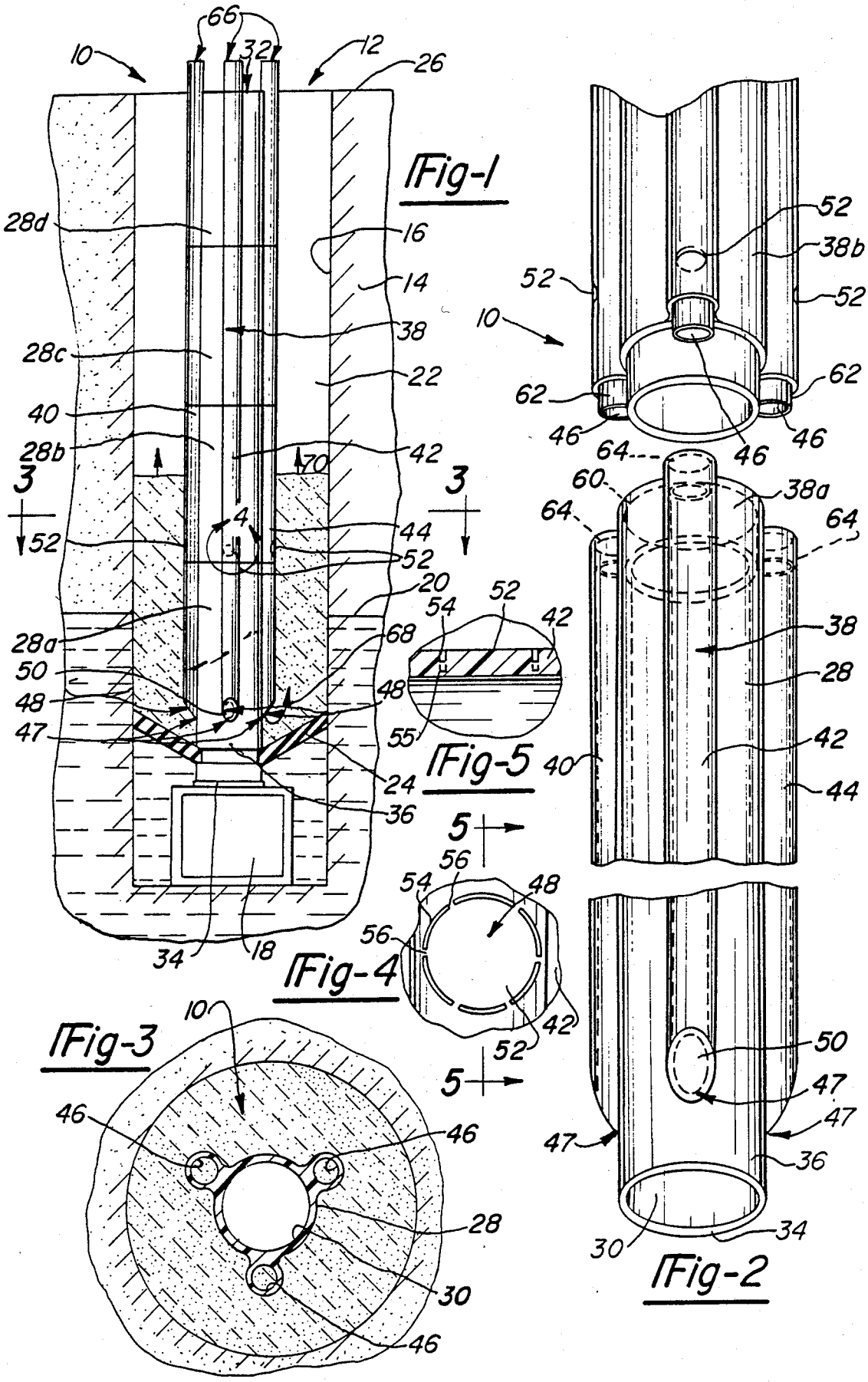
FIG. 1 is a sectional view showing the grouting well pipe of the present invention in its operational environment.
FIG. 2 is a detailed perspective view partially broken away and in phantom showing the grouting well pipe of the present invention.
FIG. 3 is a sectional view taken along line 3—3 of FIG. 1.
FIG. 4 is a detailed elevational view of a grouting release structure which may be utilized in accordance with the teachings of the present invention.
FIG. 5 is a cross-sectional view of the grouting release structure of FIG. 4 taken along line 5—5 of FIG. 4.

In accordance with these objectives in the present invention there is provided a grouting well pipe for a water well. The grouting well pipe of the present invention includes a central well pipe which has a central opening for passing of water therethrough from the water well. The well pipe includes an upper surface and a lower well end. The lower well end includes a boot securement portion adapted for allowing placement of a sealing boot thereon. The well pipe has at least one grouting tube integrally attached to the central well pipe and extending substantially from the upper surface to the boot engagement portion. The grouting tube is substantially sealed for preventing clogging of the grouting tube during insertion of the well pipe into a water well hole. The grouting pipe includes a first grout release means for opening of the grout tube at a location adjacent the boot securement portion of the well pipe in response to a first predetermined pressure being imposed through the interior of the grout tube. A second grout release means is provided on the grout tube for opening of the grout tube at a location which is spaced from the first grout release means. The second grout release means is openable in response to a second predetermined pressure greater than the first predetermined pressure being imposed on the interior of the grout tube.

Thus, in the present invention the grout can be pumped into the space formed between the well pipe and the well hole through the first pressure release means by pumping of grout into the grout tube at the first predetermined pressure or alternatively, through the second grout release means if the first grout release means is blocked by pumping grout through the tube at the second predetermined pressure.

DETAILED DESCRIPTION OF THE PREFERRED EMBODIMENT

Referring now to the drawings, according to the present invention there is provided a grouting well pipe, generally shown at 10, for a water well 12.

In water well drilling operations a water well hole 12 must be drilled in a suitable location in the ground 14. This is accomplished by known means using known equipment and leaves a generally cylindrical shaped hole 16 in the ground 14. The water well pipe is thereafter inserted into the hole with a pump 18 at its lower end. The lower end having the pump is positioned beneath the water table level 20 in order to pump water from the water table 20 to the surface for use. While close tolerances are generally preferred in use of well pipes within water well holes there is invariably a gap 22 between the water pipe and the sides 16 of the water well (this gap 22 is exaggerated herein for purposes of illustration of the present invention).

As discussed above, in prior art methods an inverted cone type boot, such as that shown at 24, is provided at the lower end of the well pipe in an attempt to seal the gap 22 between the well pipe and the sides of the well. In the present invention a method and apparatus is provided for effectively grouting the space 22 in order to seal the space 22 from entry of contaminants from the surface 26 of the ground 14 through this gap 22.

The grouting well pipe 10 of the present invention includes a central well pipe portion 28. The central well pipe 28 includes a central opening 30 for passing of water therethrough for use at the surface. The central well pipe 28 includes an upper surface end portion 32 and a lower well end portion 34. The lower well end portion 34 includes boot securement portion 36 for allowing placement of a sealing boot 24 thereon.

At least one grouting tube 38 is integrally attached to the central well pipe 28 along the length thereof. Preferably, a plurality of circumferentially spaced grout tubes is provided along the periphery of the central well pipe 28. In a preferred embodiment as shown in the figures, there are three grout tubes 40, 42 and 44. The grout tubes 40, 42 and 44 include central openings 46 through which a grouting material may be pumped.

The grout tubes 40, 42 and 44 are substantially sealed at their lower ends 47 and along their length for preventing clogging of the grouting tube during insertion of the well pipe into that water well hole. Usually, the upper ends of the grout tubes may remain open. The grout tubes 40, 42 and 44 utilized in the present invention include grout release structures generally indicated at 48 for releasing the grout in response to a predetermined pressure being imposed on the central opening 46 of the grout tubes 40, 42 and 44.

In a preferred embodiment of the present invention, a first grout release structure 50 is provided for opening of a particular grout tube at a location adjacent the boot securement portion 36 in response to a first predetermined pressure being imposed on the interior of the grout tube. A second grout release structure 52 is provided on the tubes 42, 44 and 46 for opening of the particular grout tube at a location which is spaced from the first grout release structure 50. The second grout release structure 52 is openable in response to a second predetermined pressure which is greater than the first predetermined pressure such that grout can be pumped between the well pipe and the well hole through the first grout release structure 50 by pumping grout into the grout tube at the first predetermined prssure. Alternatively, if for some reason the first grout release structure 50 is clogged or blocked grout can be released in the space 22 by pumping grout through the tube at a second higher predetermined pressure for opening of the second grout release structure 52.

Preferably, grout release structures 50 and 52 are integrally molded blowout plugs such as shown in more detail in FIGS. 4 and 5. Referring to FIGS. 4 and 5, the release structure 52 includes a blowout plug 53 integrally formed in the side wall of the grout tube 42 by scoring or otherwise indenting an outline of the plug such as by utilization of grooves 54. The grooves 54 include arcuate groove portions which generally form a circular blowout plug. The arcuate grooves have web portions 56 therebetween. The web portions 56 help to retain the structural integrity of the grout tube structure prior to blowing out the plug 53 thereby preventing unwanted rupture of the blowout plug 53 or of the tube which would act to clog the tube or block the flow of grout through the tube. As shown in FIG. 5, the amount of pressure necessary to blowout the plugs may be adjusted by varying depth of the groove 54 such as shown in phantom at 55.

In a preferred embodiment of the invention the first grout release structure 50 is provided for a release of grout at a pressure of about 25 psi and the second release structure 52 would provide for a release of grout at a pressure of about 50 psi such that the lower blowout plug will preferentially blowout prior to blowout of the upper blowout plug. This is accomplished by scoring the side wall of the grout release structure 50 correspondingly deeper, such as shown in phantom at 55 shown in FIG. 5, at the blowout plug of structure 50 than at the blowout plug of structure 52. While the above structure is preferred other types of grout release structures may be utilized in the present invention without deviating from the scope of the present invention.

Referring to FIGS. 1 and 2, the grouting well pipe 10 of the present invention may include separate sections, i.e., such as **28*a* and 28*b* for insertion into the well. These sections are interconnected through corresponding male 58 and female 60 connection portions as shown in the drawings, as are commonly utilized in conventional well pipes. Similarly, the grouting tubes 40, 42 and 44 include corresponding male 62 and female 64** fittings to provide sealing engagement between the pipes.

The present invention is particularly useful today with the advent of plastic water piping such as PVC or the like. In these applications while surface contamination is a problem to be remedied by the grouting well pipe of the present invention, the present invention also has the advantage of helping to reduce freeze-thaw type damage to which PVC piping and the like is particularly susceptible. The present invention provides a substantially complete grouting of the space 22 which thereby reduces or eliminates gaps in which water could accumulatee and cause damage to the pipe during freezing thereof.

In a preferred embodiment of the present invention the grouting well pipe is produced from a PVC material with the grouting tubes 40, 42 and 44 extruded, during manufacture, directly onto the central well pipe 28. However, it is within the scope of the present invention that the grouting tubes 40, 42 and 44 may be otherwise attached with adhesives such as epoxies or other known materials depending on the type of material used for the pipe and grouting tubes. Similarly, if steel pipe were used, the grouting tubes could be welded or brazed on the central well pipe.

Generally, the sections of **28*a*, 28*b*, 28*c* and 28*d*, per common pipe drilling practices, are about 50 feet long in practice thus, spacing the first grout release structure 50 from the second release structure 52 by a preferred distance of about 50 feet however, the spacing may be varied to accommodate the particular use. It is preferred that the first and second release structures are vertically spaced from one another to provide a different zone of the well for release of the grout. Extra sections such as 28c and 28d may be utilized to provide communication of the well pipe and the grouting tubes to the surface. In a preferred embodiment as shown in the drawings, the lower end includes a closed off end having an integral grout release structure 50** therein which is sloped toward the central well pipe to provide for ease of insertion of the well pipe assembly in the well hole.

In operation, after drilling of the well hole 16 the boot 24 is attached to the boot engagement portion of the lower section 28a of the grouting well pipe of the present invention. Thereafter, this is inserted at the surface at the hole 16 and slid into the hole until the upper end thereof is generally even with the surface wherein portion 28b is attached thereto and further inserted in the hole. These steps are repeated with portion 28c or 28d or the like as necessary until the bottom end of the well pipe with the pump 18 attached thereto is at a suitable distance in the well below the water table level 20. Thereafter, a pump assembly is securely attached to one of the grout tubes such as tube 42 for pumping grout into the tube 42 at a pressure of 25 psi, for instance, shown by arrow 66. Thereafter, grouting such as bentonite, cement or other cementatious materials are pumped through the interior 46 of the grout tube 42 to build up pressure to the breaking point of the first release structure 50.

The release mechanism is blownout as set forth above and grout begins to be pumped into the space 22 as shown by arrow 68. Because of the boot 24 generally engaging the side 16 of the well the grout begins to fill the space 22 and progress towards the surface as shown by arrows 70 displacing any drilling mud or the like which is left in the space 22. This is continued until grout is even with the surface 26 whereby the entire space 22 is secured from entry of surface contamination.

Assuming the lower plug of the selected grout tube is plugged by way of obstruction or other problem the pressure of the grout tube exerted on the interior thereof is increased to the second predetermined pressure, i.e., about 50 pounds in the preferred embodiment and the second release mechanism 52 is ruptured or blownout thereby providing an alternate route for the grouting to fill the space 22. A plurality of the tubes 40, 42 and 44 are provided such that should one of the tubes be completely blocked, another tube be selected and grout may be pumped therethrough as set forth above. In an alternate embodiment of the method it is preferred that each grout tube may be utilized to further enhance and ensure sealing of the space 22.

The present invention has been described in an illustrative manner. It is to be understood that the terminology which has been used is intended to be in the nature of words of description rather than of limitation. Obviously, many modifications and variations of the present invention are possible in light of the above teachings. Therefore, within the scope of the appended claims, the present invention may be practiced otherwise than as specifically described.

What is claimed is:

1. A grouting well pipe for a water well comprising: a central well pipe having a central opening for passing of water therethrough, said central well pipe including an upper surface end and a lower well end, said lower well end including a boot securement portion adapted for placement of a sealing boot thereon, at least one grouting tube integrally attached to the central well pipe and extending substantially from said upper surface and to said boot engagement portion, said grouting tube being substantially sealed along its length and at the end adjacent said boot engagement portion for preventing clogging of said grouting tube during insertion of said grouting well pipe into a water well hole, said grouting tube including a grout release means for release of grout from said grout tube into the well hole for surrounding said grouting well pipe with grout and sealing of the area between said grouting well pipe and the well hole with a grouting composition, said grouting release means for releasing of grout into said area upon pumping of grout into said grout tube at a first predetermined pressure.

2. The grouting well pipe of claim 1 wherein said grout release means further comprises a blowout plug integrally formed in the wall of said grouting tube.

3. The grouting well pipe of claim 2 wherein said end of said grouting tube adjacent said boot engagement portion is sloped toward said boot engagement portion, said blowout plug being formed in said sloped end.

4. A grouting well pipe for a water well comprising: a central well pipe having a central opening for passing of water therethrough, said central well pipe including an upper surface end and a lower well end, said lower well end including a boot securement portion adapted for allowing placement of a sealing boot thereon; at least one grouting tube integrally attached to said central well pipe and extending substantially from said upper surface end to said boot engagement portion, said grouting tube being substantially sealed for preventing clogging of said grouting tube during insertion of said grouting well pipe into a water well hole and including a first grout release means for opening of said grout tube at a location adjacent said boot engagement portion in response to a first predetermined pressure being imposed in the interior of said grout tube; and a second grout release means for opening of said grout tube at a location which is spaced from said first grout release means in response to a second predetermined pressure greater than said first predetermined pressure, wherein grout can be pumped between said grouting well pipe and the well hole through said first pressure release means by pumping grout into said grout tube at said first predetermined pressure or alternatively, through said second grout release means if said first grout release means is blocked by pumping grout through said tube at said second predetermined pressure.

5. The well pipe of claim 4 wherein said first and second grout release means further comprise blowout plugs integrally formed in the wall of said grout tube.

6. The well pipe of claim 4 further comprising a plurality of said grouting tubes circumferentially spaced about said casing.

7. The well pipe of claim 4 wherein the end of said grouting tube closest to said boot portion is angled toward said well casing and said first grout release means is situated at said angled end of said grout tube.

8. The well pipe of claim 7 wherein said first grout release means comprises a blow out plug integrally formed in the end wall of said angled end.

9. The well pipe of claim 5 wherein said blowout plugs are formed by scoring the wall of the grout tube to provide a frangibly removable plug.

10. The well pipe of claim 4 wherein said first grout release means is vertically spaced from said second grout release means.

* * * * *

UNITED STATES PATENT AND TRADEMARK OFFICE

CERTIFICATE OF CORRECTION

PATENT NO. : 4,909,323

DATED : March 20, 1990

INVENTOR(S) : James E.L. Hastings

It is certified that error appears in the above-identified patent and that said Letters Patent is hereby corrected as shown below:

On the Title Page under "U.S. Patent Documents", please add:

| | | | |
|---|---|---|---|
| 2,939,533 | 6/1960 | C.J. Coberly | 166/68 |
| 3,245,222 | 4/1966 | M. Galaup | 405/267 |
| 3,540,225 | 11/1970 | L. Muller | 405/242 |
| 3,973,408 | 8/1976 | Paverman | 52/729X |
| 4,496,268 | 1/1985 | Ressi di Cervia | 405/267X |

Col. 3, Line 58, "prssure" should be --pressure--;

Col. 4, Line 48, "accumulatee" should be --accumulate--.

Signed and Sealed this

Sixth Day of October, 1992

*Attest:*

*Attesting Officer*

DOUGLAS B. COMER

*Acting Commissioner of Patents and Trademarks*